US007214867B1

(12) United States Patent
Gatzen et al.

(10) Patent No.: US 7,214,867 B1
(45) Date of Patent: May 8, 2007

(54) DRUMHEAD TONE CONTROL DEVICE

(75) Inventors: Robert A. Gatzen, Newington, CT (US); Donald Dressler, Glastonbury, CT (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 159 days.

(21) Appl. No.: 10/779,342

(22) Filed: Feb. 13, 2004

(51) Int. Cl.
*G10D 13/08* (2006.01)

(52) U.S. Cl. ..... 84/411 R

(58) Field of Classification Search ..... 84/411 R, 84/413, 414
See application file for complete search history.

(56) References Cited

U.S. PATENT DOCUMENTS

| | | | | |
|---|---|---|---|---|
| 4,244,266 | A | 1/1981 | Hardy | |
| 4,798,121 | A * | 1/1989 | Donohoe | 84/414 |
| 5,159,139 | A | 10/1992 | Beals et al. | |
| 5,864,077 | A | 1/1999 | Gatzen | |
| 5,892,168 | A | 4/1999 | Donohoe | |
| 5,920,021 | A | 7/1999 | Good | |
| 6,184,451 | B1 * | 2/2001 | Miller et al. | 84/414 |
| 6,291,753 | B1 | 9/2001 | Campbell et al. | |
| 6,291,754 | B1 | 9/2001 | Gatzen et al. | |
| 6,365,812 | B1 * | 4/2002 | McGill | 84/414 |
| 6,518,490 | B2 * | 2/2003 | Good | 84/414 |
| 6,608,134 | B1 * | 8/2003 | Tobing et al. | 524/501 |

* cited by examiner

*Primary Examiner*—Kimberly Lockett
(74) *Attorney, Agent, or Firm*—Alix, Yale & Ristas, LLP

(57) ABSTRACT

A drumhead tone control device employs an annular configuration of polyester film tightly adhered to the periphery of a drumhead membrane. The annular configuration of the tone control device includes radial and/or circumferential relief. The relieved tone control device disrupts transmission of vibrations reflected from the drumhead membrane/drum shell interface. Disruption of reflected vibrations improves the overall tonal quality of the drumhead while use of a tightly adhered polyester sheet close to the periphery of the drumhead playing surface minimizes undesirable alteration of the attack characteristics and fundamental tone of the drumhead.

23 Claims, 5 Drawing Sheets

DRUMHEAD TONE CONTROL DEVICE

BACKGROUND OF THE INVENTION

1. Field of the Invention

This invention relates generally to the field of musical drums, and is more particularly directed to an active, stress relieved tone control device for a drumhead.

2. Description of the Related Art

Modern drumheads are typically constructed of single or multiple layers of synthetic plastic materials such as polyethylene, polypropylene, polyester and the like. A drumhead sheet of plastic material is formed to a shape that will fit over the open end of a drum shell. The peripheral edges of the formed drumhead sheet are secured within a rigid drum hoop, typically constructed of metal. Tensioning devices engage the hoop and adjustably tension the drumhead over the drum shell. Generally speaking, higher tension on the drumhead produces higher pitch vibrations when the drumhead is struck. The "attack" is the initial period of a generated tone. When the drumhead is struck a number of frequencies are excited and the nature of the attack characteristics, the clarity and crispness of the fundamental tones, are developed. Frequency control is a key element to shaping the attack characteristics.

Plastic sheet materials have proven to be exceptionally durable, attractive and adaptable to the manufacture of drumheads for musical drums. Synthetic sheet materials, however, also have some undesirable vibration characteristics that have come to the attention of both musicians and sound engineers. Synthetic drumheads have a tendency toward sustained vibration where the peripheral portions of the drumhead emit unwanted ringing and overtones that detract from the sound of the primary fundamental tones of the drum.

One theory of the cause of ringing is that the vibrations of a plastic drumhead, which result when the drum is struck by the drummer, move radially outwardly toward the edge or rim of the drum, reach the periphery thereof, and are reflected back by the rim. As the reflected vibrations are returning toward the center of the drum, if the drum is struck again, the most recently induced vibrations, which, at this point, are traveling outwardly, will meet the returning reflected vibrations from the previous beat. It is the meeting and crossing of vibrations which causes the effect known as ringing. The crossing vibrations, and resultant sound waves, produce a distorted drum tone which varies in pitch; hence, the term ringing. This phenomenon was not as severe a problem when drumheads were made principally of natural products such as calfskin or other "gut" type materials which do not conduct the reflected vibrations as efficiently as do the synthetic drumhead-membranes.

Since the relatively recent advent of the use of plastic and synthetic drumheads, and the accompanying increase in the ringing phenomenon, drummers have searched for methods of reducing or eliminating this problem, in an effort to achieve a more pure percussive tonal quality. The first, crude efforts of musicians involved placing pillows, rugs, or other materials inside the drum shell and in contact with the drumhead, to reduce the amount of return vibration, thereby reducing the ringing phenomenon. Although moderately effective, the use of such materials in the drum shell is inconvenient, unsightly and impractical for drums which are to be carried by marching band members or the like. Large bulky items, such as pillows or rugs, when stuffed in the drum shell, also retard the originating vibrations to a greater degree than is desirable, hence reducing the volume of the desired percussion. With the popularity of clear plastic drumheads, items such as those mentioned, being stuffed into the drum shell, present a totally unacceptable appearance when used in public performance.

More recently, drum and drumhead manufacturers have taken up the search for effective tone control in synthetic drumheads that is less obtrusive, more effective and adaptable to marching and stationary drums. Currently, the known techniques for dampening a drumhead include adding an additional element that is applied to the drumhead, i.e., a screen printed coating, vinyl or foam applique. An example of such an adhesive patch is seen in U.S. Pat. No. 4,244,266. Screen printed coatings tend to provide inadequate control over drumhead ringing, while vinyl and foam appliques have a tendency toward negative effects on the attack and fundamental tone of the drumhead. Another method currently used is a dampening or tone control device, formed of a polymer film loosely placed against the drumhead about the peripheral edge of the drumhead. The film is not adhered to the drumhead and therefore vibrates out of phase with the drumhead. This technique is shown in U.S. Pat. No. 5,159,139. While devices of this type have been successful, further improvements in tone control are believed possible.

An important objective is to control the amount of overtone content without changing, i.e. dulling, the attack characteristics. This is particularly important because the primary sound that humans relate to in musical listening is attack. In fact, it is considered to be an audio phenomena that the listener is tremendously affected by attack characteristics in tone generated by musical instruments. The attack period of a generated tone communicates the emotion and the rhythmic scheme of a musical performance.

SUMMARY OF THE INVENTION

Previous drumhead dampening devices have tended to imitate the crude musician-generated "deadening" devices by employing materials and configurations calculated to absorb vibrations. As discussed above, these prior art devices tend toward overly aggressive dampening and an undesirable alteration of the drumhead performance.

An aspect of the present invention relates to use of synthetic film materials for the tone control device that are very similar to, if not the same as, the membrane of the drumhead itself. A tone control device according to aspects of the present invention is an annular formation of synthetic film tightly adhered to the periphery of the drumhead membrane. The similarity of the material of the tone control device to the drumhead membrane assures that the tone control device will behave very similarly to the drumhead membrane in response to applied forces. Thus, changes to the drumhead attack characteristics and fundamental tones from installation of the tone control device are less drastic than the changes produced by prior art devices employing materials that are dissimilar to the drumhead.

Another aspect of the invention relates to employing a thin, aggressive adhesive to bind the tone control film to the drumhead membrane. Tight adhesion of the tone control device to the drumhead limits the effect of the adhesive on vibration of the drumhead membrane.

A further aspect of the invention relates to configuring the tone control device into a discontinuous or convoluted repeating pattern around the periphery of the drumhead. Such a pattern may employ a ring-shaped pattern of discrete film pieces, shaped inner or outer annular edges or a pattern of cut-outs within a ring-shaped device. While the function of such a pattern on tone control is not completely understood, discontinuities in the tone control device may serve to break up reflected membrane vibrations and thus prevent interference with subsequent fundamental vibrations.

It is an object of the present invention to provide a new and improved drumhead tone control device which can be placed on a drumhead and will substantially reduce the intensity of vibrations reflected by the rim of the drum, thus substantially decreasing the ringing phenomenon while not interfering with the playing of the drum, and which will present a pleasing appearance when used on transparent drumheads.

Another object of the present invention is to provide a new and improved drumhead tone control device which can be attached directly to the drumhead membrane and will stay attached thereto, permitting it to be used with drums carried by marching band members and the like, and will stay in place after once having been installed, thus not requiring installation each time the drum is to be used.

A further object of the present invention is to provide a new and improved drumhead that exhibits reduced ringing, yet does not substantially interfere with the desired percussive tone, quality and volume of the drum.

A still further object of the present invention is to provide a new and improved drumhead tone control device which can be manufactured in a variety of sizes, can be manufactured inexpensively, and which can be produced in a variety of shapes, designs and colors, thus providing unique visual appearances when used on transparent drumheads.

BRIEF DESCRIPTION OF THE DRAWINGS

These and other objects and advantages of the present invention will be apparent from the following detailed description of the preferred embodiments and the accompanying drawings, wherein.

DETAILED DESCRIPTION OF THE EXEMPLARY EMBODIMENTS

Figure 1:
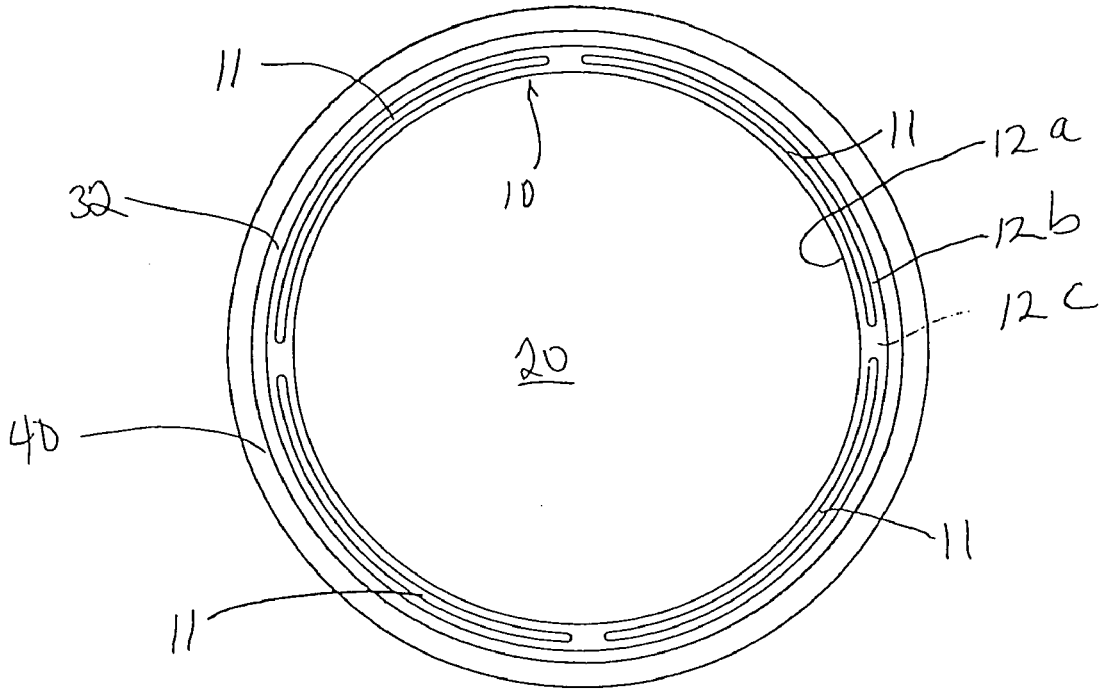
FIG. 1 is a bottom view of a drumhead equipped with a tone control device according to aspects of the present invention.
Figure 2:
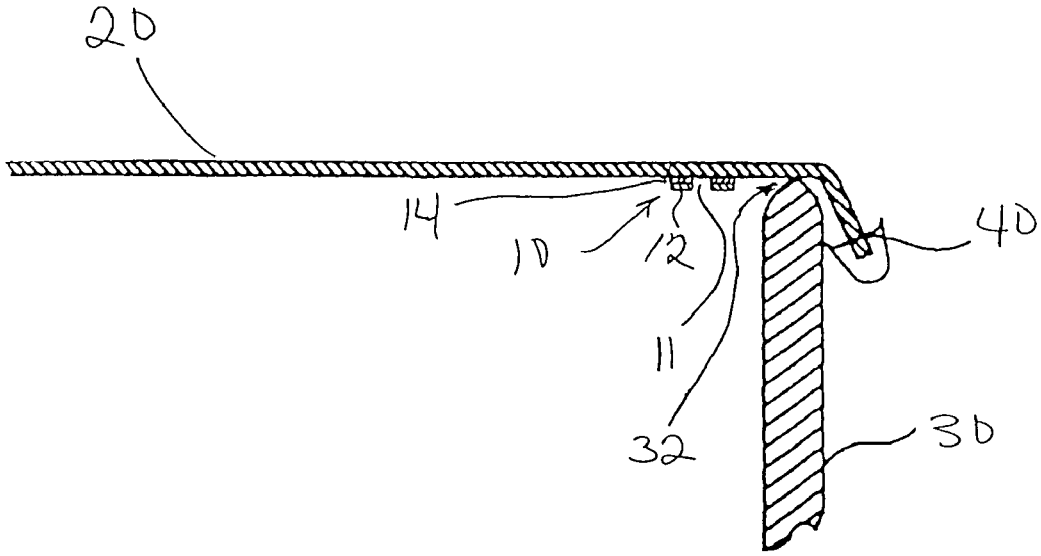
FIG. 2 is a partial sectional view through a drumhead equipped with a tone control device according to the present invention, as installed over a drum shell.

Exemplary embodiments of a drumhead tone control device according to aspects of the present invention will now be described with reference to FIGS. 1–10. FIGS. 1 and 2 illustrate the typical use environment for a tone control device 10 according to the present invention. Exemplary tone control device 10 is a ring of polyester sheet material with a thin and aggressive adhesive backing. The tone control device 10 is applied to the surface of a drumhead membrane 20, radially inwardly of where the drumhead membrane bears against a drum shell 30 as shown in FIG. 2. The illustrated tone control device is shown adhered to the inside surface of the drumhead membrane although it is technically feasible to apply the tone control device to the outside or playing surface of the drumhead membrane. Application to the underside of the drumhead membrane 20 is preferred as less likely to interfere with playing of the instrument.

One preferred material for modern synthetic drumheads is polyester sheet, sometimes referred to by the trade name Mylar™. The drumhead membrane 20 may include one or more layers of polyester film. Drumheads for marching drums may employ sheet materials woven from Kevlar or Aramid fibers. While tone control devices according to aspects of the present invention are generally effective for tone control in synthetic drumheads, they may also be employed on natural drumheads. Drumheads are typically pre-formed during manufacture with a flat crown or playing surface surrounded by a contoured or down-turned lip or rim extending to the peripheral edge of the drumhead membrane 20. The peripheral edge of the drumhead membrane is typically embedded in an epoxy-based adhesive in a drumhead hoop 40. Tensioning apparatus engage the drumhead hoop to tension the drumhead over a drum shell 30 as shown in FIG. 2. The upper rim of the drum shell 30 bears against the underside of the drumhead membrane 20 inwardly of the drumhead membrane periphery. It is this drumhead/drum shell interface which is believed to reflect the drumhead membrane vibrations which lead to dissonance and ringing in plastic drumheads.

Drumheads are manufactured to fit standardized drum shells. For example, a ten inch (10") drumhead is configured so that the down-turned lip and hoop fit over the outside of the drum shell and the rim of the drum shell bears on the periphery of the flat playing surface. This means that the diameter of the drumhead hoop is actually larger than the stated size of the drumhead. The stated size of the drumhead more closely approximates the diameter of the flat playing surface.

Figure 3:
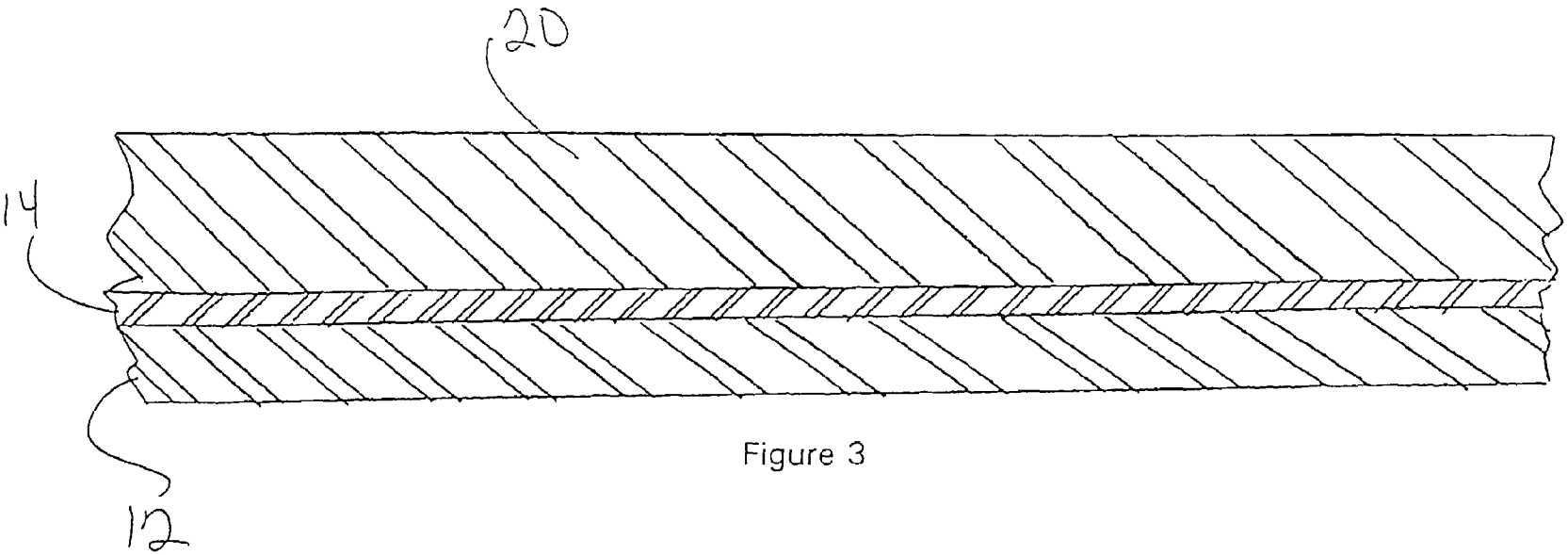
FIG. 3 is an enlarged partial sectional view through a drumhead membrane and tone control device according to aspects of the present invention.
Figure 4:
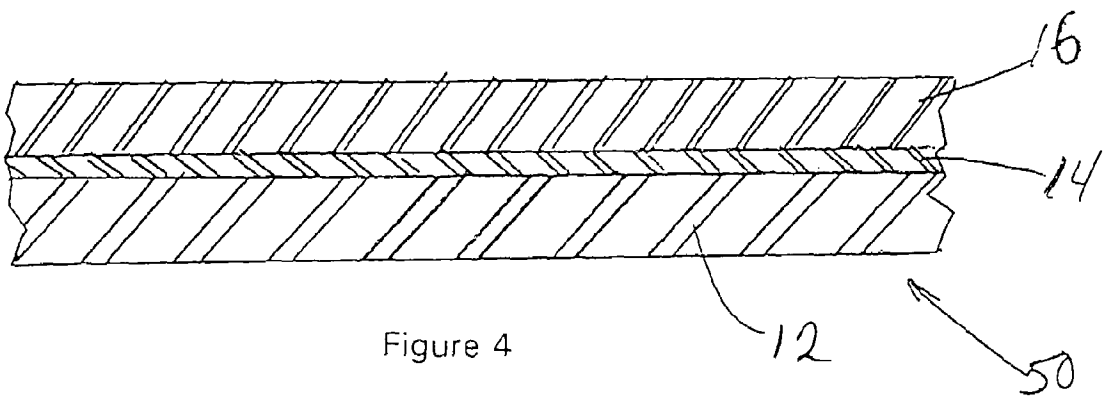
FIG. 4 is a partial sectional view through a tone control device according to aspects of the present invention.
Figure 5:
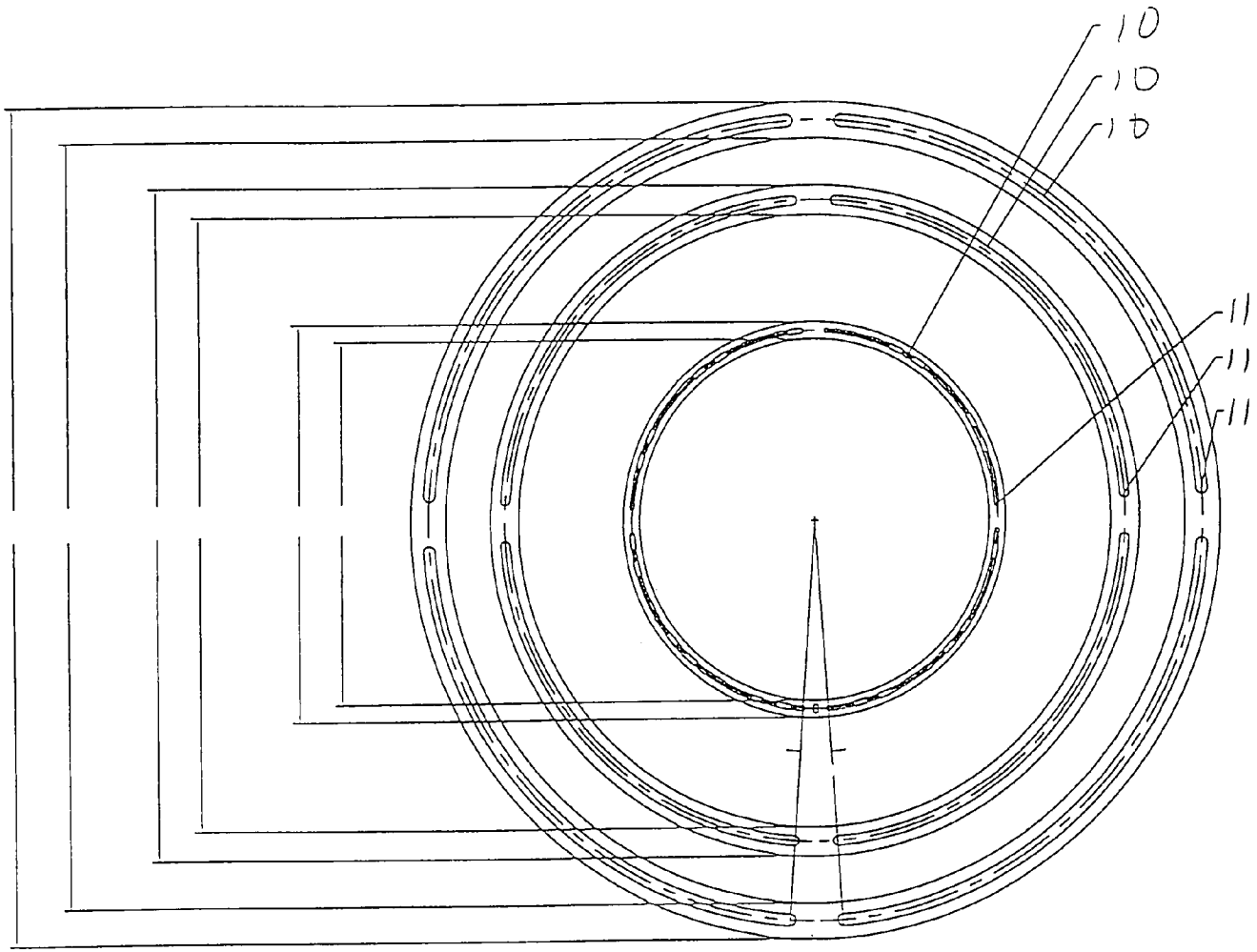
FIGS. 5 and 6 are representative tone control devices for different size drums arranged concentrically for die cutting from a single sheet of stock.
Figure 6:
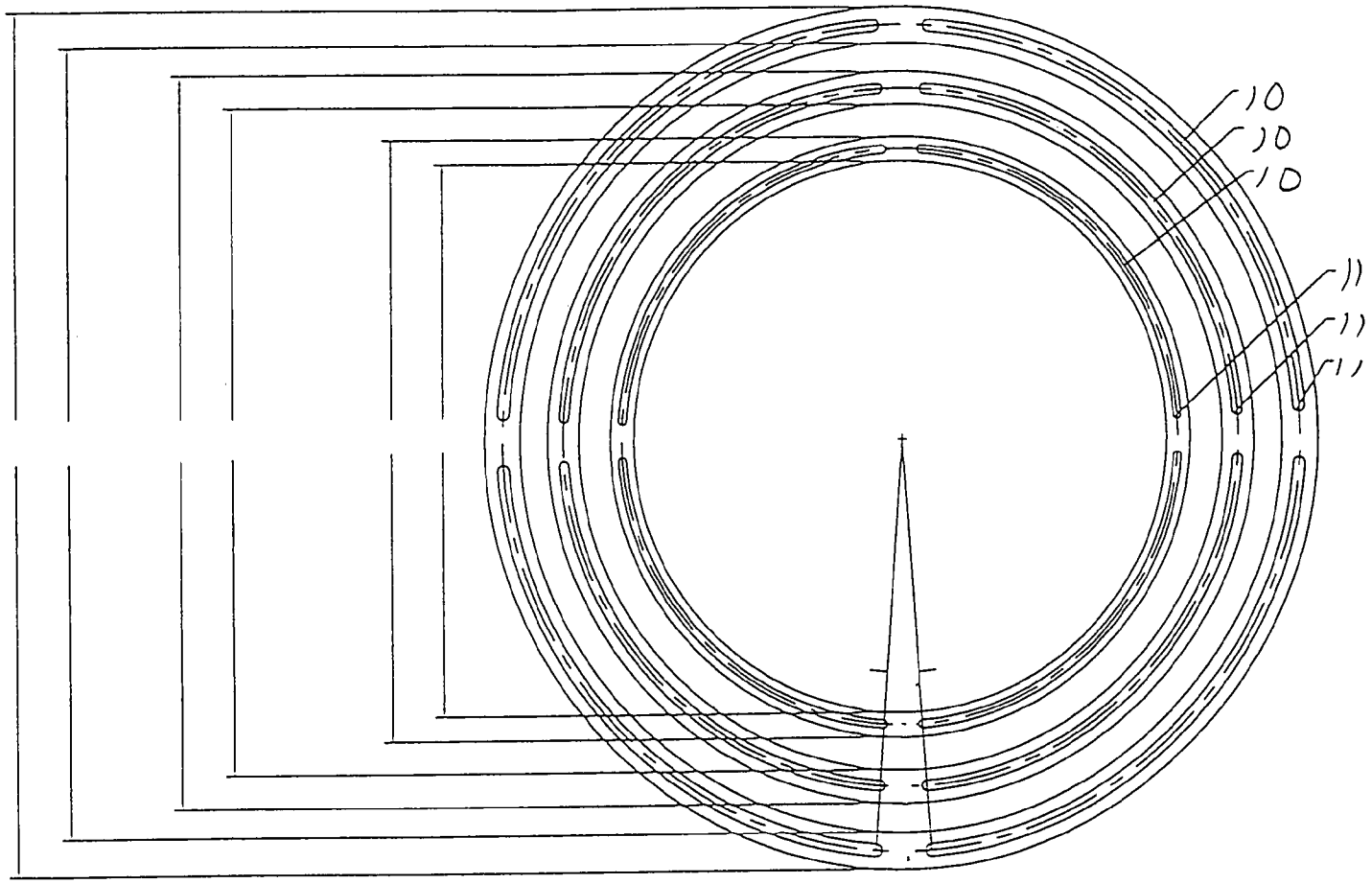

FIG. 3 is an enlarged sectional view through a drumhead membrane 20 to which a tone control device is applied. A thin layer of aggressive high-tack adhesive 14 holds the tone control sheet material 12 onto the underside of the drumhead membrane 20. According to aspects of the present invention, the tone control device is manufactured from polyester sheet substantially identical to the polyester sheet from which the drumhead membrane 20 is formed. The polyester sheet is coated with a thin and aggressive adhesive 14 and provided with a release liner 16. The resulting stock material 50 illustrated in FIG. 4 is then die cut to the shapes and sizes appropriate for a particular drumhead. Tone control devices for several drumhead sizes can be simultaneously cut using die configurations illustrated in FIGS. 5 and 6. FIG. 5 illustrates a die layout for tone control devices sized for 8", 13" and 16" drumheads. FIG. 6 illustrates a die layout for tone control devices sized to fit 10", 12" and 14" drumheads. The term "stated diameter of the drumhead" means the size of the drum on which the drumhead is intended to be used and closely approximates the diameter of the flat playing surface of the drumhead.

The tone control devices illustrated in FIGS. 1, 5 and 6 have an outside diameter approximately three quarters of an inch (0.75") less than the stated size of the drumhead. The illustrated tone control devices have a radial width that varies with the size of the drumhead. Tone control devices for larger diameter drumheads have a greater radial width than those for smaller diameter drumheads. The radial width of the illustrated tone control devices are in a range of between 5% and 10% of the stated diameter of the drumhead, and more particularly in a range of between 7% and 8.5% of the stated diameter of the drumhead. These dimensions place the tone control device at the periphery of the flat playing surface while allowing room for the drumhead membrane to bear directly on the rim of the drum shell. A tone control device outside diameter of between 0.5" and 1" less than the diameter of the flat playing surface of the drumhead is believed to allow sufficient clearance for the drumhead membrane/drum shell interface.

The release liner 16 shown in FIG. 4 is removed and the tone control device 10 is applied to a surface of the drumhead membrane 20 with the adhesive 14 between the polyester sheet 12 of the tone control device and the drumhead membrane 20. This is preferably performed when the drumhead membrane is flat, before assembly to the hoop. One adhesive that has been shown to produce acceptable results is an acrylic pressure-sensitive adhesive having a high-tack and high-peel strength. The adhesive should age well, without discoloration. The polyester tone control material 12 can have a decorative finish such as color or a metallic coating applied prior to coating with adhesive. Decorative finishes applied to the tone control material will show through a transparent or translucent drumhead membrane. The polyester tone control material 12 may also be surface treated to improve the bond between the material and the adhesive. FLEXcon of Spencer, Mass. manufactures an appropriate acrylic adhesive under the brand name V-606. The adhesive is applied in a thin, substantially uniform coat having a thickness of approximately one one thousandth of an inch (0.001") or less. An adhesive thickness in the range of five ten thousandths to as much as three thousandths of an inch (0.0005"–0.003") should be satisfactory.

The adhesive should remain somewhat viscoelastic to accommodate flexure of the drumhead membrane without deterioration of the bond with the tone control member 12 during die cutting, fabrication of the drumhead and tensioning of the drumhead over the drum shell. Tightly adhering the tone control device 10 to the drumhead membrane 20 with a thin layer of aggressive adhesive helps to minimize the deleterious effects on the attack and fundamental tones of the drumhead. Thick layers of adhesive or materials such as adhesive-backed foam tape typical of the prior art have a tendency to deaden vibrations in the drumhead membrane, undesirably altering the attack and sustain properties of the drumhead.

With particular reference to FIGS. 1 and 2, it will be noted that the exemplary tone control device 10 is in the shape of a ring that defines four circumferentially elongated arcuate slots 11 surrounded by outer and inner polyester sheet material 12*a*, 12*b* connected by web portions 12*c*. The entire surface of the tone control device 10 is adhered to the drumhead membrane. All the layers of the stock material 50 from which the tone control devices are cut are removed in the areas of the arcuate slots 11 so that there is an open space between the inner and outer portions of the tone control device as shown in FIG. 2.

The vibration characteristics of the drumhead membrane 20 are at least in part determined by the tension placed on the membrane in combination with the mass per unit area of the membrane. It will be noted that the tone control device 10 effectively provides localized increased mass per unit area concentrated at the periphery of the drumhead membrane but radially inwardly from the membrane's contact with the drum shell 30. As shown in FIG. 2, two areas of locally increased mass per unit area are separated by the arcuate slot 11 defined by the tone control device 10. This interrupted pattern of increased mass per unit area is believed to disrupt transmission of reflected vibrations toward the center of the drumhead membrane 20. This disruption accelerates the decay of reflected vibrations and serves to reduce ringing in the drumhead.

It should be noted that polyester sheet material selected for the tone control device is in the range of 2 to 5 thousandths of an inch thick (0.002"–0.005"). This will typically be thinner than the drumhead membrane, which range from approximately 10 to 14 thousandths of an inch (0.010"–0.014") in thickness. Aside from the thickness, the polyester sheet material selected for the tone control devices is preferably identical in all other respects to the polyester sheet used to form the drumhead membrane 20. This similarity insures that the tightly adhered tone control device 10 will behave very similarly to the drumhead membrane when the instrument is played, minimizing adverse effects of the tone control device on the attack and tone of the drumhead.

Figure 7:
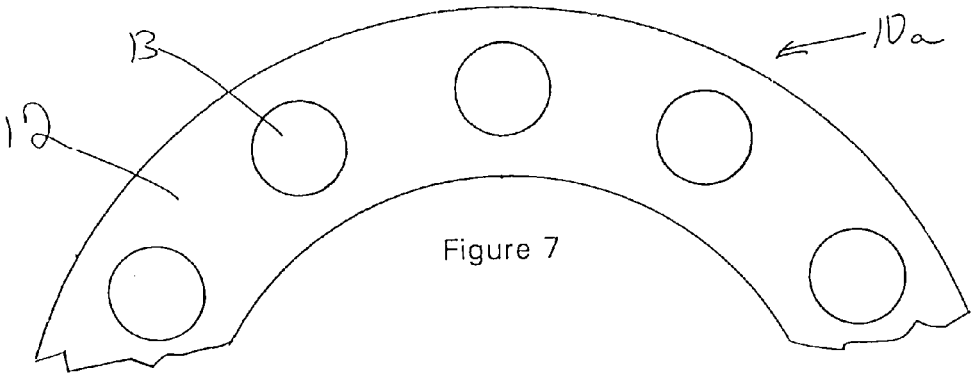
FIGS. 7–10 illustrate various other configurations of a tone control device according to aspects of the present invention.
Figure 8:
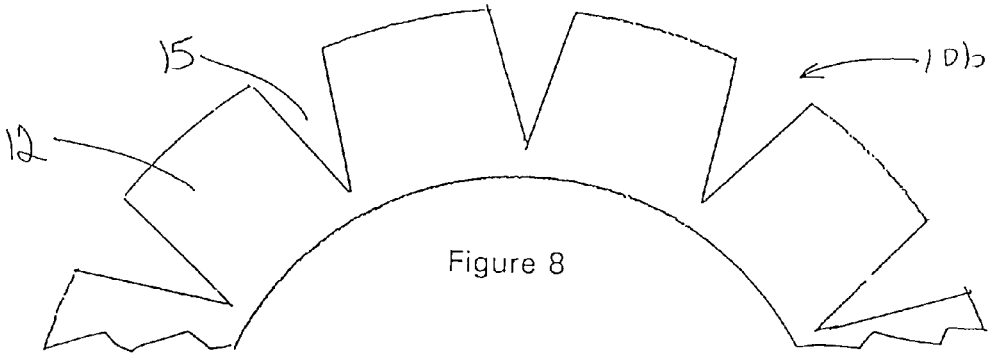
Figure 9:
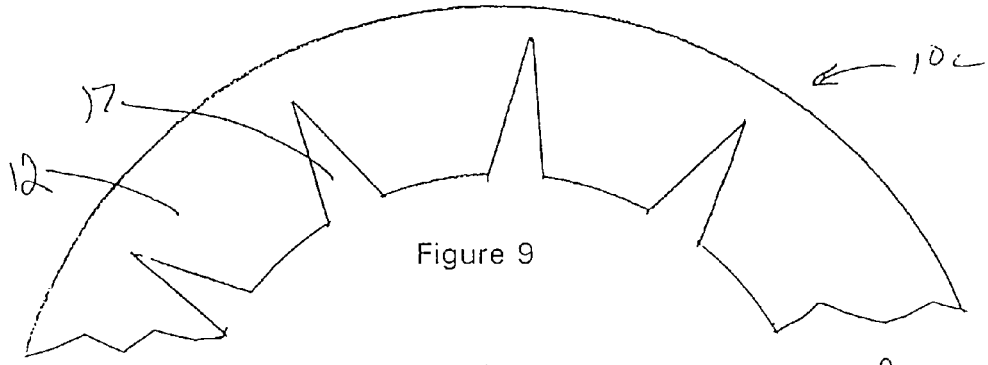
Figure 10:
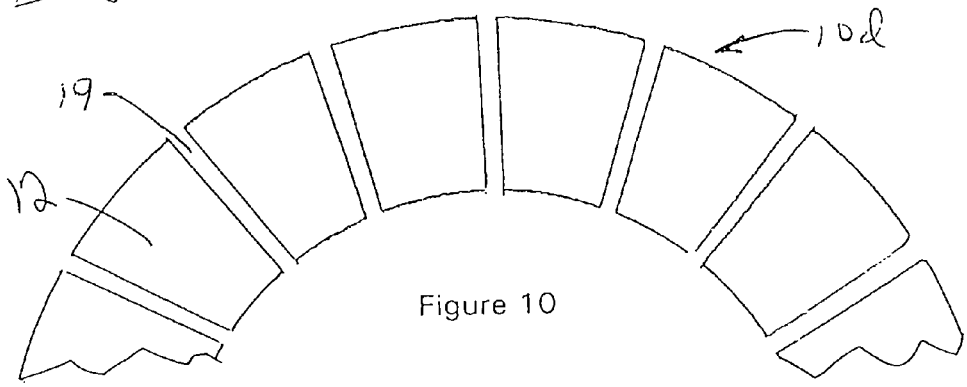

With reference to FIGS. 5–10, an aspect of the present invention relates to providing radial or circumferential relief in the annular tone control device. An example of radial relief are the arcuate elongated slots 11 shown in the tone control devices of FIGS. 5 and 6. FIG. 7 illustrates an alternative form of internally relieved annular tone control device 10*a*. Circular openings 13 are cut into the annular ring of sheet material 12 to interrupt what would otherwise be a ring of sheet material. FIG. 8 illustrates an alternative configuration in which the outside circumference of a tone control device 10*b* is provided with notch-like relief 15. FIG. 9 illustrates a tone control device 10*c* in which the inside circumference is provided with notch-shaped relief 17. The tone control device 10*d* of FIG. 10 is made up of a plurality of discrete wedge-shaped portions arranged in an annular configuration and separated by spoke-like relief 19. The common theme among the various embodiments of tone control devices shown in FIGS. 5–10 is that of a radial or circumferential discontinuity or interruption. These interruptions are believed to disrupt transmission of membrane vibrations passing through the drumhead membrane 20 at the location of the tone control device. The disrupted vibrations decay more rapidly than if they were to be transmitted without interruption.

The tone control devices are configured for application to the periphery of the drumhead membrane 20 radially inward from the drumhead's contact with the drum shell 30. This positioning is believed to minimize the effect of the tone control device on the attack characteristics and fundamental tones of the drumhead while maximizing disruption of vibrations reflected from the drumhead membrane/drum shell interface 32. A preferred location for the tone control devices is in the outermost 20% of the drumhead membrane. The width of the illustrated tone control devices measured in the radial direction is between approximately ⅜ and ¾ of an inch (0.375"–0.75"), although other radial widths may provide acceptable results.

While exemplary embodiments of the foregoing invention have been set forth for purposes of illustration, the foregoing descriptions should not be deemed a limitation of the invention herein. Accordingly, various modifications, adaptations and alternatives may occur to one skilled in the art without departing from the spirit and the scope of the present invention.

What is claimed is:

1. A drumhead for musical drums comprising:

a circular membrane of plastic film having a substantially flat crown and a contoured outer rim retained in a circular hoop;

an annular formation of plastic film intimately adhered with a viscoelastic adhesive to the membrane and having a plurality of relief irregularities;

wherein said annular formation is entirely located in the radial outward-most 50% of said crown; and wherein the membrane has a thickness in the range of 10 to 15 mils, the formation has a thickness in the range of 3 to 5 mils, and the adhesive has a thickness in the range of 0.5 to 3 mils.

2. The drumhead of claim 1, wherein the formation has a unitary, flat surface facing the underside of the membrane and all of said flat surface is adhered to the membrane.

3. The drumhead of claim 1, wherein the relief irregularities are defined by radially or circumferentially extending notches, slots, or gaps.

4. The drumhead of claim 1, wherein the relief irregularities are defined by a plurality of circumferentially spaced apart apertures.

5. The drumhead of claim 1, wherein the membrane and the formation are the same plastic material.

6. The drumhead of claim 5, wherein the material is polyester.

7. The drumhead of claim 1, wherein the adhesive is an acrylic pressure sensitive adhesive.

8. A drumhead for musical drums comprising a membrane held in a circular hoop adapted to fit over the transverse end of a hollow cylindrically-shaped drum shell, said drumhead having a drum shell contact interface where the membrane bears on said drum shell, said drumhead comprising:

an annular formation of plastic film adhered to a surface of the membrane by a layer of adhesive, said annular formation of plastic film including radial or circumferential relief provided by removal of portions of said plastic film and adhesive, wherein said plastic film is positioned at a location radially inwardly from the contact interface but in a radial outward-most 30% of said membrane.

9. The drumhead of claim 8, wherein said plastic film has a thickness that is less than a thickness of said membrane.

10. The drumhead of claim 8, wherein said plastic film is polyester and said membrane is polyester.

11. The drumhead of claim 8, wherein said layer of adhesive is an acrylic adhesive having a substantially uniform thickness of less than approximately three one thousandth of an inch (0.003").

12. The drumhead of claim 8, wherein said annular formation is a ring and said radial or circumferential relief is in the form of openings in the ring.

13. The drumhead of claim 8, wherein said annular formation has an outside diameter of between one half (0.5") and one inch (1") less than a stated diameter of the drumhead.

14. The drumhead of claim 8, wherein said annular formation has a radial width of between five percent (5%) and ten percent (10%) of the stated diameter of the drumhead.

15. A tone control device for use in combination with a drumhead, said drumhead including a drumhead membrane having a first diameter and inside and outside surfaces fixed at a circumferential edge to a drumhead hoop, said inside surface having a drum shell bearing area adjacent said drumhead hoop, said tone control device comprising:

a polyester film layer having a substantially uniform thickness in the range of 2 to 5 thousandths of an inch (0.002"–0.005") between first and second surfaces, a pressure sensitive adhesive layer having a substantially uniform thickness of approximately 3 mils or less covering one of said first or second surfaces; and a release liner removably covering said pressure sensitive adhesive layer;

wherein said tone control device is configured for adhesion to said membrane at a location radially inwardly spaced from said drum shell bearing area and in the radially outward-most 50% of said membrane.

16. The tone control device of claim 15, wherein said device defines a plurality of openings in said polyester film layer and said pressure sensitive adhesive layer.

17. The tone control device of claim 15, wherein said device comprises a radially inner ring and a radially outer ring separated by a circumferential space, said outer ring connected to said inner ring by a plurality of radial spokes.

18. The tone control device of claim 15, wherein said polyester film layer is no thicker than the drumhead membrane to which it will be attached.

19. The tone control device of claim 15, wherein said device is symmetrical about an axis centered on and perpendicular to the ring.

20. The tone control device of claim 15, wherein said device is a ring defining openings.

21. The tone control device of claim 15, wherein said device is a ring with a convoluted outer peripheral edge.

22. The tone control device of claim 21, wherein said device is a ring with a convoluted inner peripheral edge.

23. The tone control device of claim 15, wherein said device includes a plurality of substantially identical portions of said film layer, adhesive layer and release liner.

* * * * *